US006224390B1

(12) United States Patent
Mitani et al.

(10) Patent No.: US 6,224,390 B1
(45) Date of Patent: May 1, 2001

(54) COAXIAL CONNECTOR

(75) Inventors: Ikujiro Mitani; Naoyuki Asano, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/501,277

(22) Filed: Feb. 9, 2000

(30) Foreign Application Priority Data

Feb. 9, 1999 (JP) ..... 11-030739

(51) Int. Cl.[7] ..... H01R 12/00
(52) U.S. Cl. ..... 439/63
(58) Field of Search ..... 439/63, 188, 944, 439/247, 248; 200/51.1

(56) References Cited

U.S. PATENT DOCUMENTS 2,640,118 * 5/1953 Werner ..... 333/22 R
4,008,943 * 2/1977 Flatt et al. ..... 439/944
4,575,694 * 3/1986 Lapke et al. ..... 333/22 R
5,516,303 5/1996 Yohn et al. .
5,769,652 6/1998 Wider .
5,775,927 * 7/1998 Wider ..... 439/944

FOREIGN PATENT DOCUMENTS 7-37648 2/1995 (JP) .

* cited by examiner

*Primary Examiner*—Neil Abrams
*Assistant Examiner*—J. F. Duverne
(74) *Attorney, Agent, or Firm*—Kanesaka & Takeuchi

(57) ABSTRACT

A coaxial connector comprises a plug-side coaxial member (10) to be plugged with a mating connector (40) and consisting of a plug-side central conductor (12) and a plug-side outer conductor (11) and a base-side coaxial member (30) to be attached to an object and consisting of a base-side central conductor (32) and a base-side outer conductor (31) such that the plug-side coaxial member is movable in the radial direction with respect to the base-side coaxial member. The plug-side and the base-side outer conductors (10) and (30) are in contact with each other and cover almost all the plug-side central conductor (12) and a portion of the base-side central conductor (32) between the contact point with the plug-side central conductor and the connection point with the object.

7 Claims, 4 Drawing Sheets

COAXIAL CONNECTOR

BACKGROUND OF THE INVENTION

1. Field of the Invention

The present invention relates to coaxial connectors.

2. Related Art

Sometimes, it is necessary for a coaxial connector attached to a circuit board to be movable to a certain extent in a radial direction or an axial direction perpendicular to the plugging direction when the coaxial connector is plugged with a mating connector.

Japanese patent application Kokai No. 7-37648 discloses such a coaxial connector. As FIG. 4 shows, the coaxial connector comprises a plug-side coaxial member 50 to be plugged with a mating connector (not shown) and a base-side coaxial member 60 attached to a circuit board (not shown).

The plug-side coaxial member 50 consists of a dielectric member 51 having a cylindrical section 51A and a pair of extended sections 51B extending radially from the bottom of the cylindrical section 51A, and central and outer conductors 52 and 53 provided so as to cover the inner and outer surfaces of the dielectric member 51. That is, the central and outer conductors 52 and 53 have cylindrical and extended sections 52A and 53A, and 52B and 53B, respectively. In addition, protruded contacts 52C and 53C are provided on the extended sections 52B and 53B, respectively.

The base-side coaxial member 60 has a substantially rectangular dielectric block 61. An upper recess 61A extends from one side to the other side of the dielectric block 61. A central conductor connection member 62 is provided on the bottom of the upper recess 61A and folded back at the both ends of the upper recess 61A. An outer conductor connection member 63 is provided on the dielectric block 61 and has a hole 63A through which the cylindrical sections 51A, 52A, and 53A extend upwardly. It is folded back at the both sides of the dielectric block 61. In this way, the central conductor 52 is shielded by the outer conductor 53.

The protruded contacts 52C and 53C are in spring contact with the central conductor connection members 62 and 63, respectively, and the diameter of the hole 63A is greater than that of the outer conductor 52 so that the coaxial member 50 is movable in the radial direction.

The folded back portions of the inner and outer conductor connection members 62 and 63 are soldered to corresponding circuit conductors of the circuit board. Even if there is a difference in the radial direction between positions of the coaxial member 50 and a mating connector, the coaxial member 50 is moved in the same direction and plugged with the mating connector without producing any stress in the base-side coaxial member 60.

However, the coaxial connector as shown in FIG. 4 has disadvantages that the shielding made by the outer conductor is not perfect and that the characteristics vary with the axial distance between the circuit board and the mating connector.

First of all, as shown in FIG. 4, sides of the outer conductor connection member 63 are opened, and there is no shield on the sides of the central conductor 52 and the central conductor connection member 62. This area is so large that it has large influence on the characteristics of the coaxial connector.

The plug-side coaxial member 50 of the coaxial connector is not axially movable with respect to the base-side coaxial member 60 so that if the distance between circuit boards on which the mating connector and the base-side coaxial member 60 are attached, respectively, is changed, the depth of plugging with the plug-side coaxial member 50 of the mating connector is changed. Consequently, the shield range is changed, resulting in the changed characteristics.

SUMMARY OF THE INVENTION

Accordingly, it is an object of the invention to provide a coaxial connector which has the improved shield characteristics and allows both radial and axial movement of the plug-side coaxial member.

A coaxial connector related to the invention comprises a plug-side coaxial member to be plugged with a mating connector and consisting of a plug-side central conductor and a plug-side outer conductor; a base-side coaxial member to be attached to an object and consisting of a base-side central conductor and a base-side outer conductor; and the plug-side coaxial member being movable in a radial direction with respect to the base-side coaxial member.

According to the invention, the plug- and base-side outer conductors are in contact with each other and cover substantially an entire length, in an axial direction, of the plug-side central conductor and a length, in the axial direction, of the base-side central conductor between a point where the plug- and base-side central conductors are contacted and a point where the base-side coaxial member is attached to the object.

If the plug-side coaxial member is shifted in the radial direction from the mating connector, it is moved in the same direction to avoid any stress acting upon the base-side coaxial member. The central conductor is almost completely shielded in the above range, thus improving the shield characteristics.

According to an embodiment of the invention, the plug- and base-side central conductors each have a sliding surface extending in the radial direction to allow radial movement of the plug-side central conductor with respect to the base-side central conductor.

According to another embodiment of the invention, the plug-side central conductor is divided into a fixed central conductor fixed to the plug-side coaxial member and a movable central conductor movable in the axial direction with respect to the fixed central conductor. The coaxial connector further comprises a first spring member provided between the fixed and movable central conductors for biasing the movable central conductor against the base-side central conductor for slidable spring contact with the base-side central conductor. Upon radial movement, the plug-side central conductor is biased against the base-side central conductor under a predetermined contact pressure, thereby providing stable contact conditions.

More specifically, the fixed central conductor is provided with a recess for receiving a stem portion of the movable central conductor to form a space between them for accommodating the first spring therein, with ends of the first spring member engaged with a bottom of the recess and a jaw of the movable central conductor, respectively, thereby biasing the movable central conductor in the axial direction. In such an embodiment, the first spring is a coil spring.

According to the invention, the base-side coaxial member comprises a support extending from the base-side outer conductor and spaced from the plug-side outer conductor in the radial direction so as to allow radial movement of the plug-side coaxial member and having an engaging jaw at a position corresponding to a midpoint, in the axial direction, of the plug-side outer conductor such that the engaging jaw engages an engaging shoulder of the plug-side outer conductor in the axial direction. A second spring member is provided between the plug- and base-side coaxial members to bias the engaging shoulder against the engaging jaw. If the position of connection with the mating connector is shifted in the axial direction, the plugging depth between the plug-side coaxial member and the mating connector is kept constant by means of the second spring member, thereby providing stable shield effects.

According to an embodiment of the invention, the plug- and base-side outer conductors each have an opposed surface extending in the radial direction, between which the second spring member is provided. It is preferred that the second spring member is a spring washer having a circular

DESCRIPTION OF THE PREFERRED EMBODIMENTS

Figure 1A:
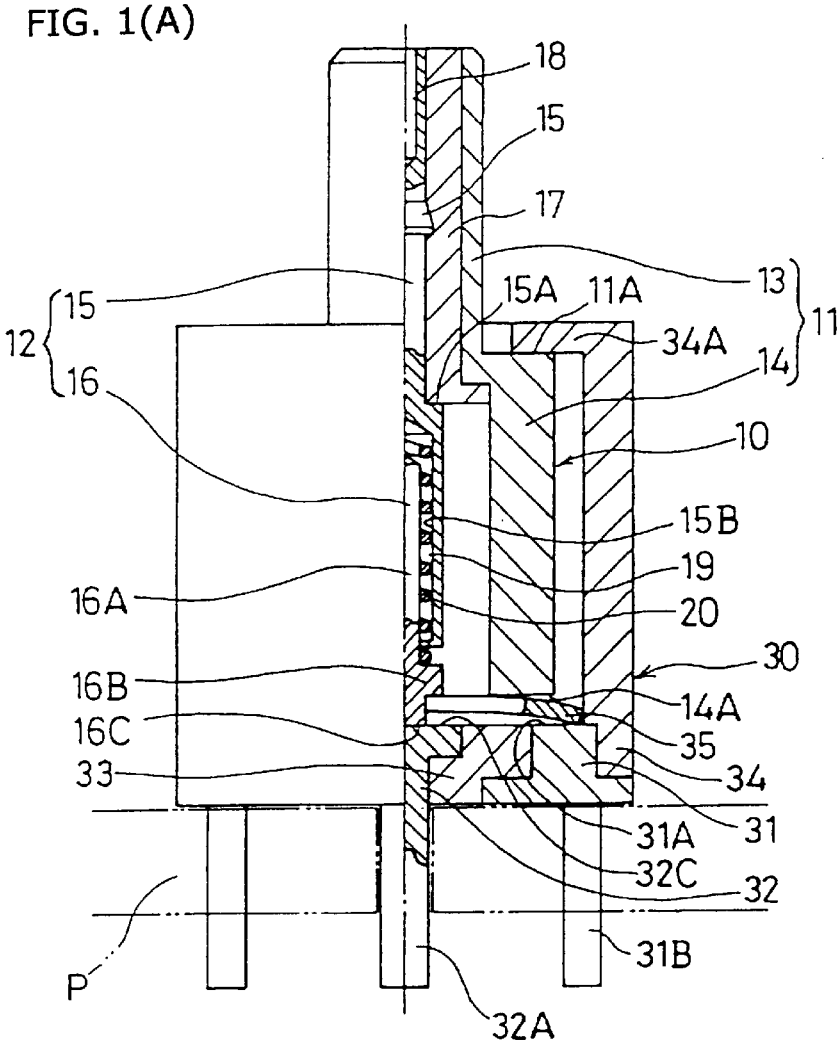
FIG. 1(A) is a side elevational view, partially in section, of a coaxial connector according to an embodiment of the invention.

Embodiments of the invention will now be described with reference to FIGS. 1(A) and (B) and FIGS. 23.

In FIG. (A), a coaxial connector comprises a coaxial member 10 to be plugged with a mating connector (not shown) and a base member 30 to be attached to an object.

The coaxial member 10 consists of a cylindrical outer conductor 11 and a central conductor 12 provided within the outer conductor 11. The outer conductor 11 has a shoulder 11A at a middle position in the axial direction, forming an upper small-diameter section 13 and a lower large-diameter section 14. The small-diameter section 13 has an outer surface contacted with a mating connector.

The central conductor 12 is aligned with the central axis of the outer conductor 11 and divided into a fixed central conductor 15 and a movable central conductor 16 at an axial middle point. The fixed central conductor is supported by the small-diameter outer conductor 13 via a dielectric member 17. It has a circular projection 15A at an axial middle point to prevent separation from the dielectric member 17 once inserted thereinto from below.

A female plugging section 18 is provided on the top of the fixed central conductor 15 to receive a male plugging pin of a mating connector. A shoulder 15A is provided at a middle point of the fixed central conductor 15, forming a lower large-diameter section in which a recess 15B is provided. Upon insertion from below, it engages the bottom face of the dielectric member 17 to position the fixed central conductor 15 in the dielectric member 17.

The movable central conductor 16 has an upper axial section 16A and a lower larger-diameter jaw section 16B. Most of the axial section 16A is located within the recess 15B of the fixed central conductor 15, forming an annular space 19 between them. A coil spring 20 is provided in the annular space 19 between the top of the recess 15B and the jaw section 16B so that the movable central conductor 16 is supported by the fixed central conductor 15 via the coil spring 20 and is biased downwardly by the coil spring 20 at the jaw section 16B.

The base member 30 consists of an outer conductor 31 and a central conductor 32 provided within the outer conductor 31. The central conductor 32 is supported by the outer conductor 31 via a dielectric member 33. The central conductor 32 extends downwardly through the dielectric member 33, forming a connection section 32A connected to a circuit board P. The connection section 32A passes through a through-hole of the circuit board P and soldered to a circuit conductor on the back side of the circuit board P. The top face 32C of the central conductor 32 is in slidable contact with the bottom face 16C of the movable central conductor 16 so that the movable central conductor 16 is biased by the coil spring 20 against the top face 32C and is movable in both the axial and radial directions.

A metallic support 34 is attached to the circumference of the base-side outer conductor 31 and provided with an engaging jaw 34A at the position where the engaging section 11A of the plug-side outer conductor 11 is located. The engaging jaw 34A engages the engaging section 11A of the plug-side outer conductor 11 in the axial direction.

A second spring member 35 is provided between the bottom face 14A of the large-diameter section 14 and an upper face 31A of the outer conductor 31. In this embodiment, the second spring member 35 takes the form of a spring washer with an upper circular seat. It has a central hole so that it does not block radial movement of the movable central conductor 16. Thus, it biases the outer conductor 11 upwardly so that the shoulder 11A of the outer conductor 11 is pressed against the jaw section 34A of a support member 34. The second spring member 35 may be any type of spring that biases the outer conductor upwardly.

Figure 1B:
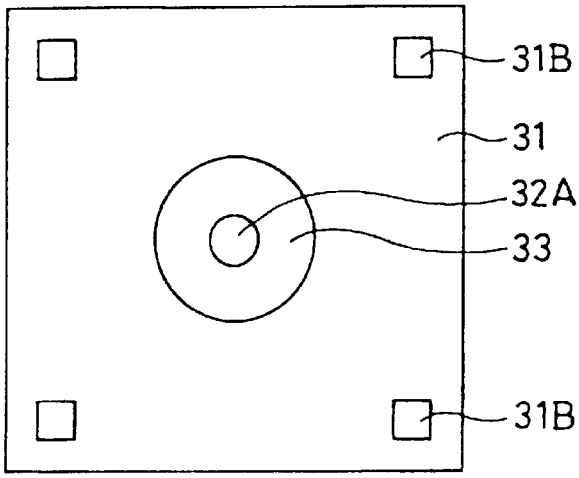
FIG. 1(B) is a bottom plan view of the coaxial connector.

In FIG. 1(B), four connection sections 31B extend downwardly from the corners of the rectangular outer conductor 31. Similarly to the connection section 32A, they are put through corresponding through-holes of the circuit board P and soldered to corresponding conductors on the back of the circuit board P.

Thus, the plug-side and base-side outer conductors 11 and 31 are electrically connected via the second spring member with a small gap while the plug-side and base-side central conductors 12 and 32 are completely surrounded and shielded by the plug-side and base-side outer conductors 11 and 31 from the point of connection with a mating connector to the point of connection with the circuit board P or the upper surface of the circuit board P.

Figure 2:
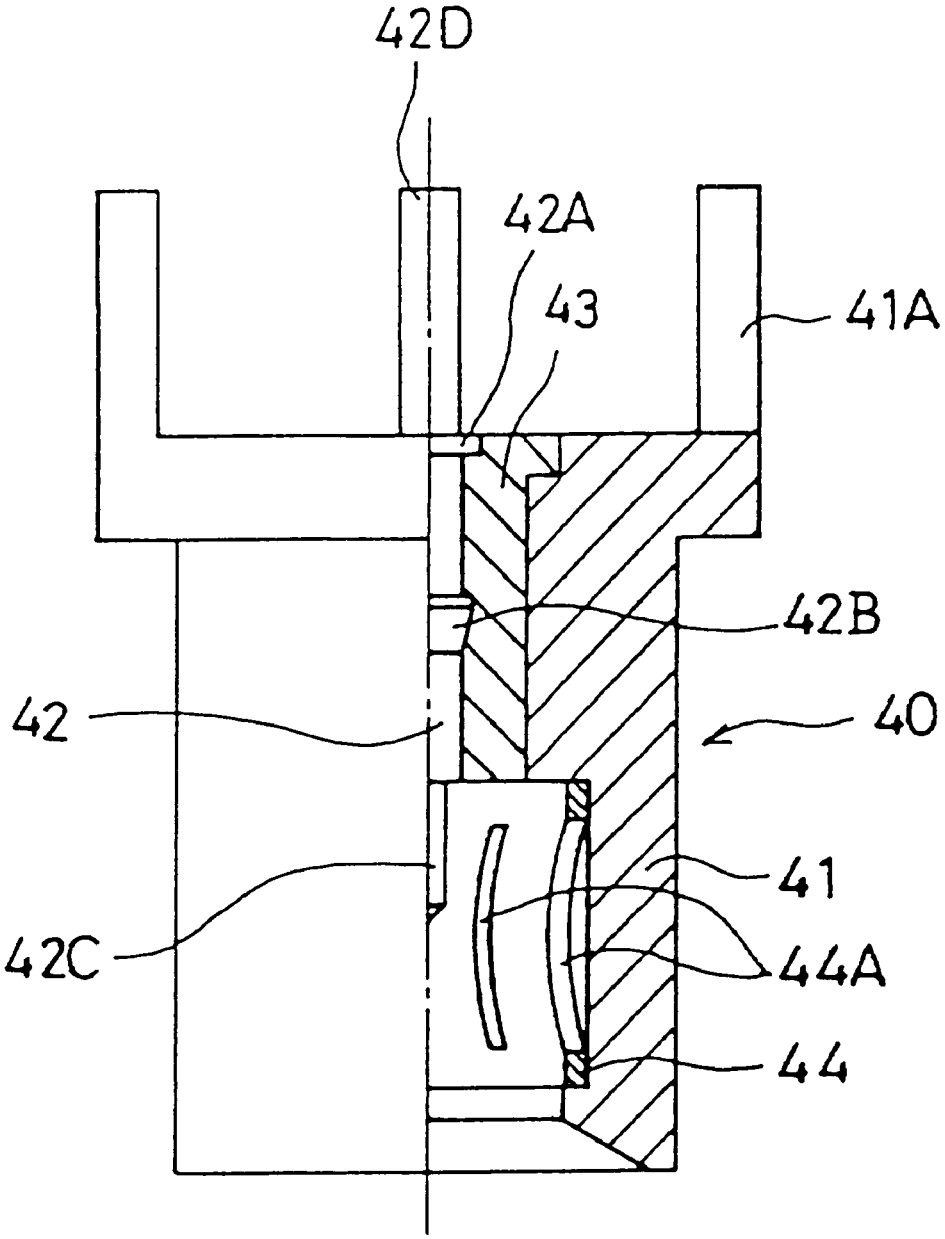
FIG. 2 is a side elevational view, partially in section, of a mating connector.

In FIG. 2, a mating connector 40 comprises a cylindrical outer conductor 41 and a central conductor 42 supported by the outer conductor 41 via a dielectric member 43.

The outer conductor 41 is provided with a circular recess in which a cylindrical spring 44 is provided. The cylindrical spring 44 has a plurality of slits 44A and is made concave so as to provide spring forces in the radial direction. A plurality of connection legs 41A extend upwardly from the top of the outer conductor 41.

The central conductor 42 has a circular engaging section 42A and a circular projection 42B at a middle portion so that it is inserted up to the circular stopper 42A and prevented from coming out by the circular projection 42B. The central conductor 42 has a male plug pin 42C projecting into a space within the spring member 44 and a connection section 42D projecting upwardly from the dielectric member 43.

Figure 3:
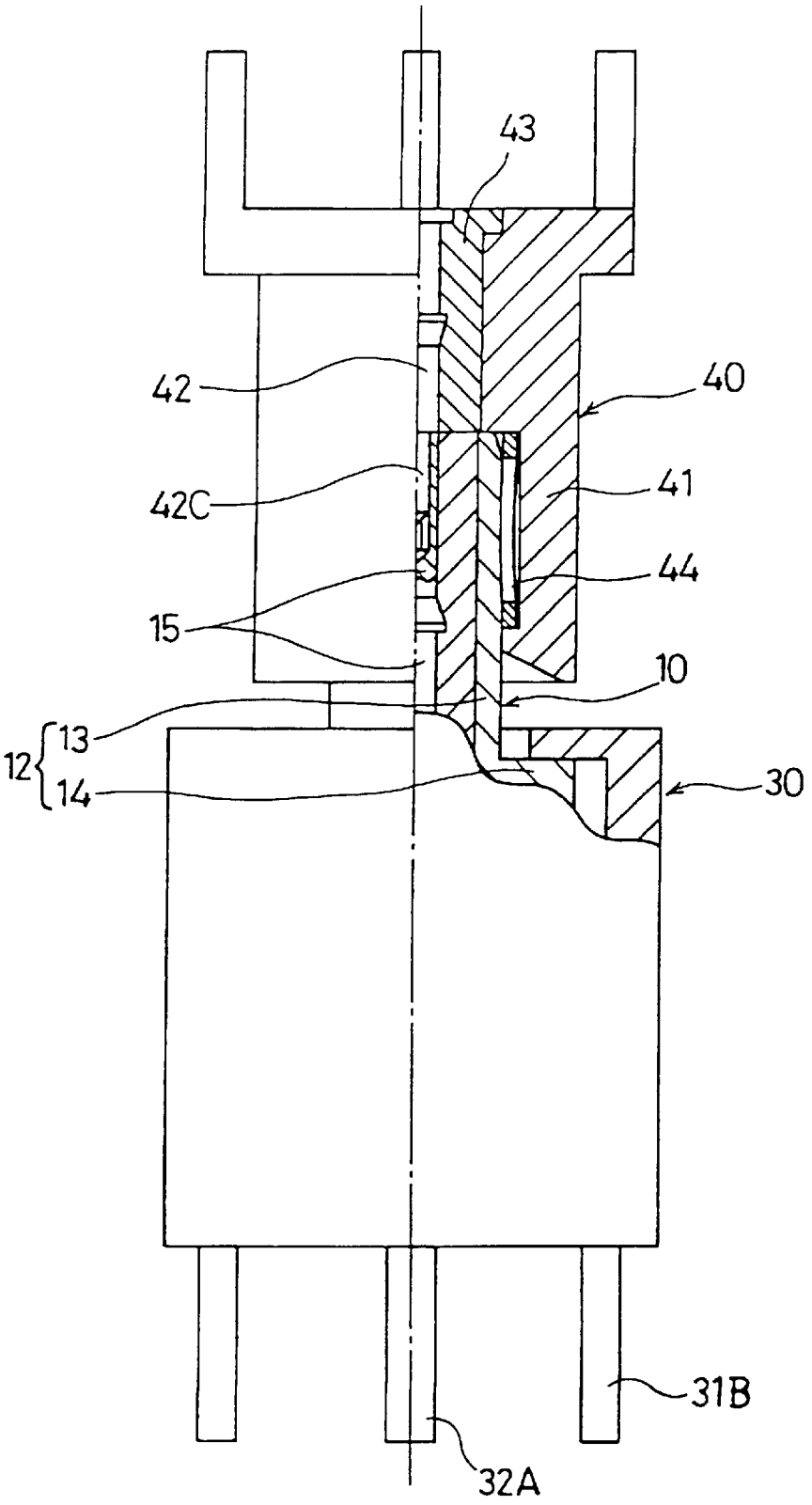
FIG. 3 is a side elevational view, partially in section, of the coaxial connectors of FIGS. 1 and 2.
Figure 4:
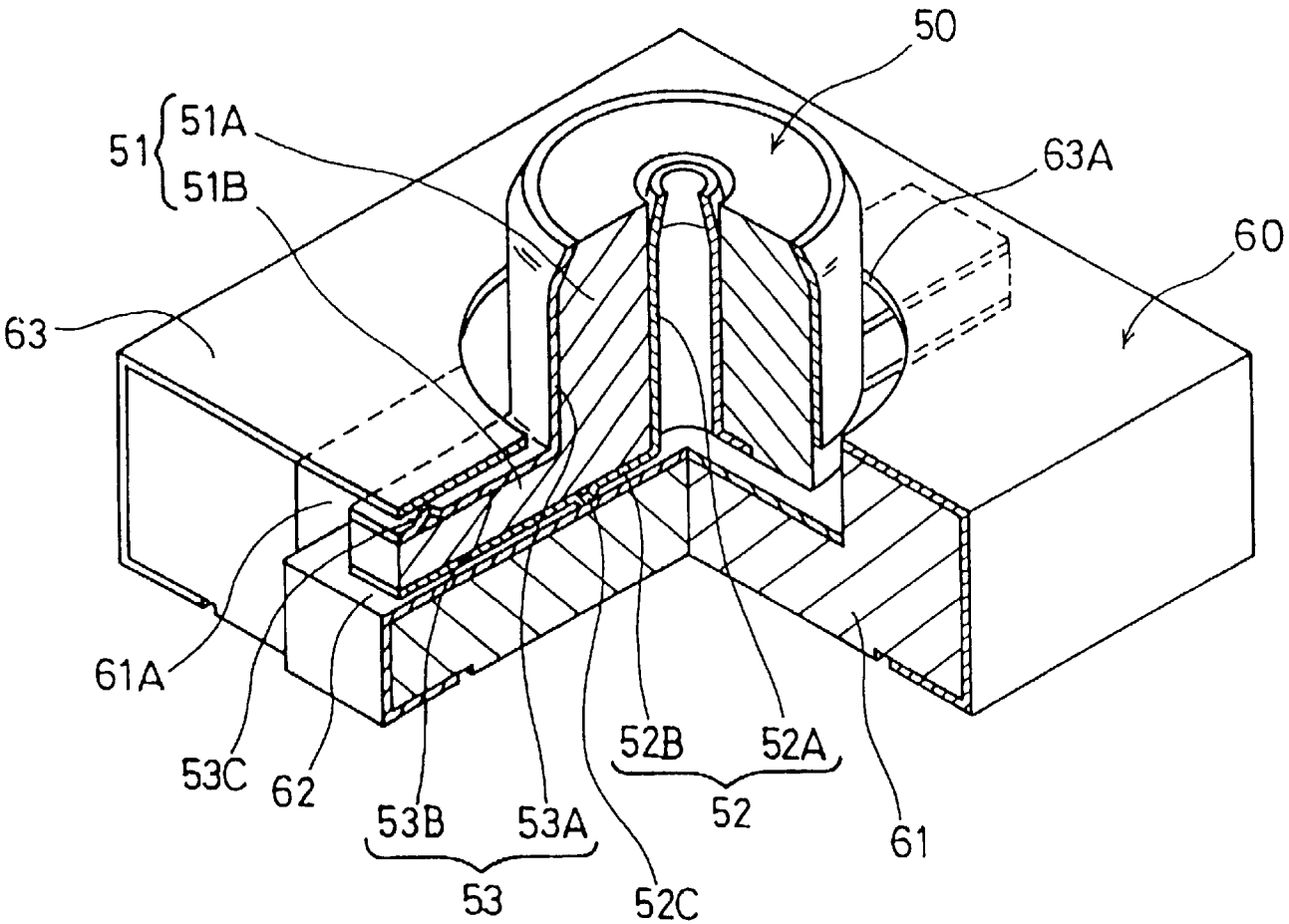
Fig. 4 PRIOR ART
FIG. 4 is a perspective view, partially in section, of a conventional connector.

In FIG. 3, the coaxial connector of FIG. 1 is plugged with the mating connector of FIG. 2. The mating connector 40 is plugged over the small-diameter section 13 of the plug-side coaxial member 10 so that the spring member 44 is brought into spring contact with the small-diameter section 13. Consequently, the outer conductor 41 of the mating connector 40 is brought into contact with the small-diameter section 13 of the outer conductor 11 with a little play. Also, the male central conductor 42 of the mating connector 40 is brought into contact with the female plug section 18 of the plug-side central conductor 12.

In the connection with the mating connector, both the plug- and base-side central conductors 12 and 32 are completely shielded by the plug- and base-side outer conductors 11 and 31 between the mating connector and the circuit board P. Under such conditions, the plug- and base-side coaxial members 10 and 30 are movable in both the radial and axial directions so that errors in the fixing position with the mating connector 40 has no influence.

If one or both of the circuit boards (not shown) on which the mating connector and the coaxial connector are attached, respectively, are shifted from normal positions in the radial direction of the coaxial connector, the plug-side coaxial member 10 is moved in the radial direction with respect to the base-side coaxial member 30 so as to adapted to it. That is, the plug-side outer conductor 11 is slid on the second spring member 35 and the engaging jaw 34A in the radial direction with respect to the base-side outer conductor 30 and support member 34. Also, the movable central conductor 16 of the plug-side central conductor 12 is slid in the radial direction on the base10 side central conductor 32 (with the sliding surfaces 16C and 32C).

If one or both of the circuit boards are moved in the axial direction and the distance between them is changed, the plug-side coaxial member 10 is moved by that much in the axial direction with respect to the base-side coaxial member 30, with the first and second spring members 20 and 34 compressed by that much. Thus, the plugging depth between the mating connector 40 and the plug-side coaxial member 10 is kept constant.

The plug-base coaxial member 10 can be slant with respect to the base-side coaxial member 30 at the sliding surfaces 16C and 32C so that if the circuit boards are slightly slant with respect to each other, such slant is absorbed by the coaxial connector. In either case, the shielding is ensured in the coaxial connector according to the invention.

As has been described above, according to the invention, the plug- and base-side coaxial members are movable with each other in the radial direction and the central conductor is completely shielded by the outer conductor so that not only errors in the plugging position in the radial direction is absorbed but only the shield characteristics are improved. In addition, the both the coaxial members are movable with each other in the axial direction so that errors in the plugging position in this direction is absorbed. Thus, not only the shield characteristics of the coaxial connector are improved but also excessive stresses resulting from errors in the plugging position are avoided to prevent damage to the circuit boards and connection points.

What is claimed is:

1. A coaxial connector comprising:

a plug-side coaxial member to be plugged with a mating connector and consisting of a plug-side central conductor and a plug-side outer conductor;

a base-side coaxial member to be attached to an object and consisting of a base-side central conductor and a base-side outer conductor;

said plug-side coaxial member being movable in a radial direction with respect to said base-side coaxial member;

said plug-side and base-side outer conductors being in contact with each other and covering substantially an entire length, in an axial direction, of said plug-side central conductor and a length, in said axial direction, of said base-side central conductor between a point where said plug-side and base-side central conductor are contacted and a point where said base-side coaxial member is attached to said object, wherein said plug-side and base-side central conductors each have a sliding surface extending in the radial direction to allow radial movement of said plug-side central conductor with respect to said base-side central conductor.

2. A coaxial connector according to claim 1, wherein said plug-side central conductor is divided into a fixed central conductor fixed to said plug-side coaxial member and a movable central conductor movable in the axial direction with respect to said fixed central conductor, said coaxial connector further comprises a first spring member provided between said fixed and movable central conductors for biasing said movable central conductor against said base-side central conductor for slidable spring contact with said base-side central conductor.

3. A coaxial connector according to claim 2, wherein said fixed central conductor is provided with a recess for receiving a stem portion of said movable central conductor to form a space between them for accommodating said first spring therein, with ends of said first spring member engaged with a bottom of said recess and a jaw of said movable central conductor, respectively, thereby biasing said movable central conductor in said axial direction.

4. A coaxial connector according to claim 3, wherein said first spring is a coil spring.

5. A coaxial connector according to claim 1, wherein said base-side coaxial member comprises:

a support extending from said base-side outer conductor and spaced from said plug-side outer conductor in said radial direction so as to allow radial movement of said plug-side coaxial member and having an engaging jaw at a position corresponding to a midpoint, in said axial direction, of said plug-side outer conductor such that said engaging jaw engages an engaging shoulder of said plug-side outer conductor in said axial direction, said coaxial connector further comprising:

a second spring member provided between said plug-side and base-side coaxial members to bias said engaging shoulder against said engaging jaw.

6. A coaxial connector according to claim 5, wherein said plug- and base-side outer conductors each have an opposed surface extending in said radial direction, between which said second spring member is provided.

7. A coaxial connector according to claim 6, wherein said second spring member is a spring washer having a circular seat.

* * * * *